US005690509A

United States Patent [19]

Eisenbraun

[11] Patent Number: 5,690,509

[45] Date of Patent: Nov. 25, 1997

[54] LIGHTED ACCESSORY POWER SUPPLY CORD

[75] Inventor: Kenneth D. Eisenbraun, Birmingham, Mich.

[73] Assignee: United Industrial Trading Corp., Troy, Mich.

[21] Appl. No.: 607,291

[22] Filed: Feb. 26, 1996

Related U.S. Application Data

[60] Provisional application No. 60/001,282, Jul. 19, 1995.

[51] Int. Cl.[6] ..... H01R 3/00

[52] U.S. Cl. ..... 439/490; 439/668

[58] Field of Search ..... 439/488, 489, 439/490, 668

[56] References Cited

U.S. PATENT DOCUMENTS

| | | | |
|---|---|---|---|
| 4,248,494 | 2/1981 | McDonald et al. | 339/154 A |
| 4,319,798 | 3/1982 | Mittelhäuser | 339/154 R |
| 4,319,799 | 3/1982 | Pearce, Jr. | 339/217 R |
| 4,322,122 | 3/1982 | Schwartz et al. | 339/147 P |
| 5,158,484 | 10/1992 | Chou | 439/668 |
| 5,170,067 | 12/1992 | Baum et al. | 307/10.1 |
| 5,201,677 | 4/1993 | Takayama | 439/668 |
| 5,244,409 | 9/1993 | Guss, III et al. | 439/490 |
| 5,326,283 | 7/1994 | Chen | 439/622 |
| 5,431,585 | 7/1995 | Fan | 439/668 |

*Primary Examiner*—Khiem Nguyen
*Assistant Examiner*—Yong Ki Kim
*Attorney, Agent, or Firm*—Gifford, Krass, Groh, Sprinkle, Patmore, Anderson & Citkowski, P.C.

[57] ABSTRACT

An electrical power supply connector is disclosed for use with a vehicle having an electrical distribution system including a cigarette lighter receptacle, the power supply connector comprising an opaque elongated body with a longitudinal axis extending the length of the body and an exterior surface having a perimeter encircling the longitudinal axis. Terminals are positioned near the first end of the body and are adapted to be inserted into the receptacle to make electrical connection with the electrical distribution system. An electrical light source is supported within the connector. Circuitry within the connector is adapted to electrically connect the light source to the electrical distribution system to energize the light source when the first end of the connector is inserted into the receptacle. A lens encircling the exterior surface of the body directs light from the light source exteriorly of the body. When the first end of the connector is in electrical engagement with the electrical distribution system, the lens is visible to an observer regardless of rotational orientation of the connector about its longitudinal axis.

7 Claims, 2 Drawing Sheets

LIGHTED ACCESSORY POWER SUPPLY CORD

This application claims the benefit of U.S. Provisional application Ser. No. 60/001,282 filed Jul. 19, 1995.

BACKGROUND OF THE INVENTION

1. Field of the Invention

The present invention relates generally to an electrical power supply connector which is inserted into a vehicle's cigarette lighter receptacle to supply power to a portable device such as a car stereo, cellular telephone, or lighting device and more particularly to such a device which provides occupants with a direct, line-of-sight view of an illuminated indicator.

2. Prior Art

Prior art electrical power supply connectors of the type suitable for use in a vehicle's cigarette lighter to supply power to a portable device generally have an elongated body having an external surface and a first end and a second end. A flexible electrical cord extends from the second end, while at least two electrically conductive terminals are located near the first end of the connector body. The terminals provide an electrical connection between the vehicle's cigarette lighter receptacle and the flexible electrical cord. Selected prior art connectors provide a light which, when illuminated, indicates that the connector is properly engaged within the receptacle. On prior art devices, this indicator light is not visible unless the connector is in a particular rotational orientation. Because connectors of this type are not typically indexed to fit into a receptacle in a particular rotational orientation, the prior art lights do not consistently provide an indication to occupants of connection status.

In particular, U.S. Pat. No. 5,432,585 discloses a power supply connector having, on its exterior surface, a compass and a lighting device which encircles the compass. The lighting device illuminates the compass and provides an indication of the status of the connection (i.e., properly seated or not properly seated within the receptacle). If the rotational orientation of the power supply connector is such that the compass is not visible to an occupant, the lighting device is also not visible to the occupant. Because receptacles will accept connectors regardless of their rotational orientation, prior art devices of this type fail to consistently provide a direct, line-of-sight indication of the status of the connection.

The present invention is accordingly directed toward a power supply connector suitable for use in a vehicle's cigarette lighter receptacle which provides occupants with a direct, line-of-sight view of an illuminated indicator regardless of the rotational orientation of the connector in the receptacle.

SUMMARY OF THE INVENTION

The present invention solves the problem of prior art power supply connectors which, when inserted into a vehicle's cigarette lighter receptacle, fail to consistently provide an illuminated indication that the connector is either properly seated or that the device attached to the connector is drawing power from the vehicle's electrical distribution system, by providing a lighted lens that encircles the perimeter of the connector such that, regardless of the rotational orientation of the power supply connector in the vehicle's cigarette lighter receptacle, the lens is directly viewable by the vehicle's occupants.

The connector is typically elongated in shape, having a longitudinal axis and a first end and a second end. The first end of the connector is insertable into the vehicle's cigarette lighter receptacle regardless of the connector's rotational orientation about its longitudinal axis. The receptacle is in electrical contact with the vehicle's electrical distribution system. The connector includes a housing having a perimeter which encircles the longitudinal axis. Terminals are positioned near the first end such that, when the connector is inserted into the cigarette lighter receptacle, the terminals are in electrical contact with the receptacle.

A flexible electrical cord having a first end in electrical connection with the terminals and a second end which is positioned exteriorly of the connector and is suitable for attachment to an electrical device such as a portable compact disc player or lighting device.

A lens supported in the body is positioned along the perimeter of the connector housing encircling the longitudinal axis such that the lens is visible regardless of the rotational orientation of the connector. For example, the lens could encircled intermediate the body its ends or be positioned on the distal end of the connector.

A light source is positioned within the connector housing such that light is directed toward the lens. The light source is electrically connected to the terminals, providing an indication that the connector is either fully engaged to the receptacle or that the portable device attached to the cord is drawing power from the vehicle's electrical distribution system.

Other objects, advantages and application of the present invention will be made clear by the following detailed description of a preferred embodiment of the invention. The description makes reference to drawings in which:

DETAILED DESCRIPTION

Figure 1:
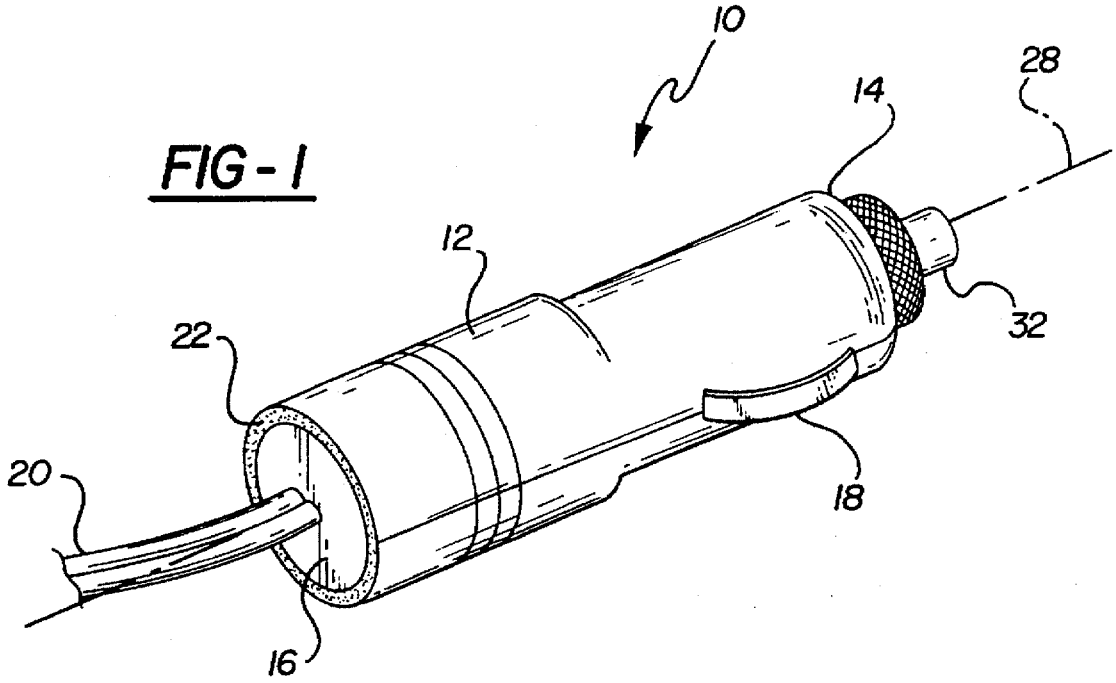
FIG. 1 is a perspective view of the invention.
Figure 2:
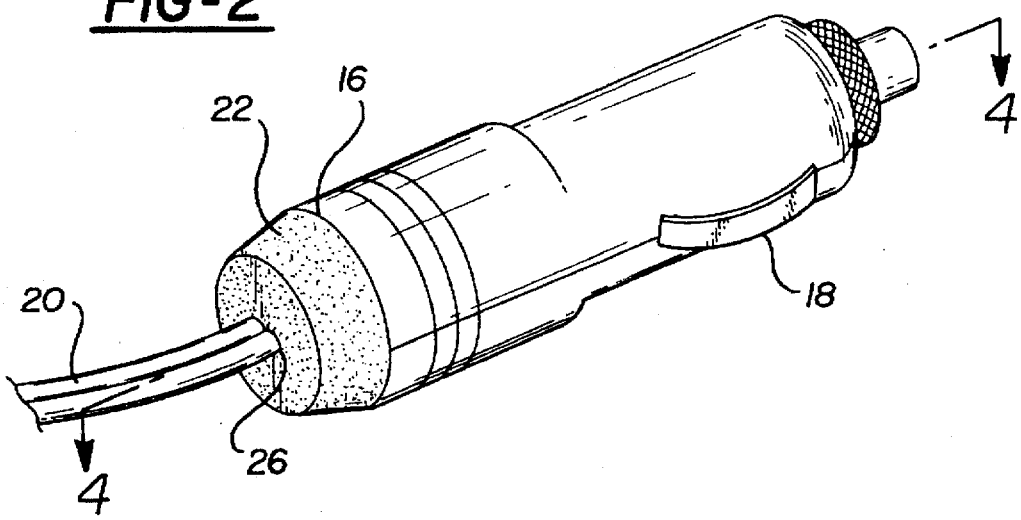
FIG. 2 is an alternate embodiment of the present invention.
Figure 3:
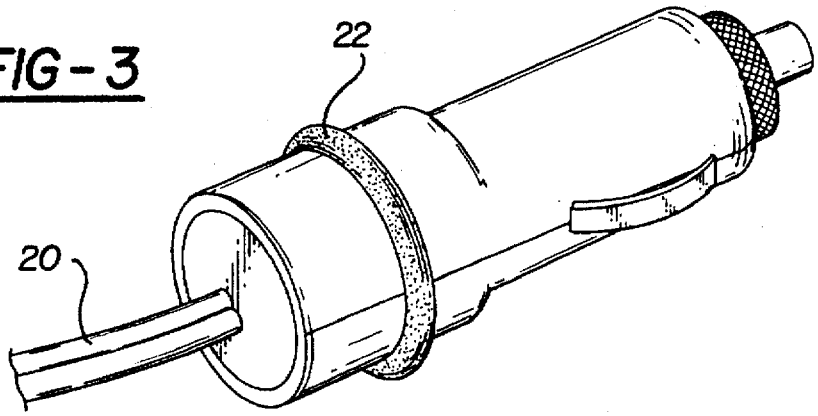
FIG. 3 is another alternate embodiment of the present invention.
Figure 4:
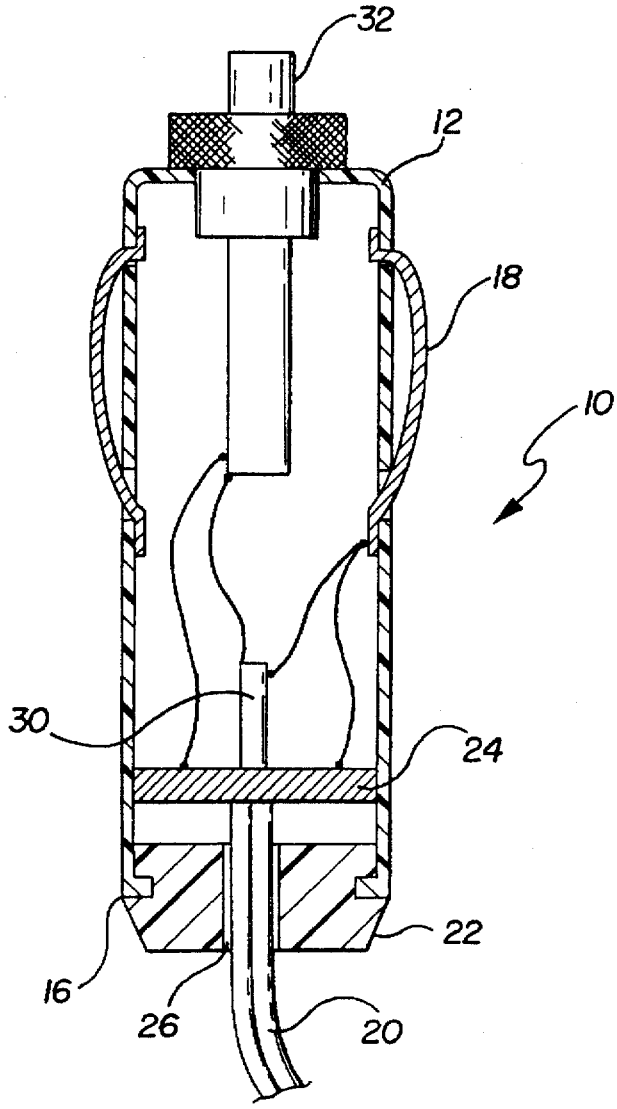
FIG. 4 is a cross-sectional view of the invention depicted in FIG. 2.

The invention, as shown in FIG. 1, is an electrical power connector 10 having a housing 12 having an exterior 12 and first and second ends, 14 and 16 respectively. The connector 10 is inserted into a vehicle's cigarette lighter receptacle (not shown) which is in electrical contact with the vehicle's electrical distribution system (also not shown). As depicted in FIGS. 1 and 4, an electrically conductive terminals 18 and 32 are positioned near the first end 14 such that, when the connector 10 is inserted into the receptacle, the terminals 18 and 32 are in electrical contact with the receptacle. As shown in FIG. 4, terminal 18 is in electrical communication with the end 30 of electrical cord 20 and light source 24. The flexible electrical cord 20 extends from the second end 16 and has an end suitable for attachment to an electrical device (not shown). A lens 22 supported in the housing 12 is positioned on the exterior of the housing 12 such that the lens 22 is visible regardless of the rotational orientation of the connector 10 about its longitudinal axis 28. As shown in FIG. 1, the lens 22 is positioned on the second end 16 of the connector body 10. FIG. 2 illustrates an embodiment wherein the lens 22 completely covers the second end 16 and the cord 20 passes through an aperture 26 in the lens 20. In FIG. 3, the lens 22 is positioned on the exterior surface and intermediate the ends of housing 12. As clearly shown in FIGS. 1, 2 and 3, the housing 12 is opaque.

Alternatively, a plurality of lenses could be used to achieve the same effect as the lenses illustrated in FIGS. 1, 2 and 3. For example, a series of short lens segments placed in close proximity to each other along the perimeter of the exterior surface of housing 12 provides a visual effect similar to a lens which is a single ring positioned on the exterior surface of housing 12.

Lenses may be colored or clear, and may be of any cross-sectional shape, such as rectangular, triangular or circular. Lenses may be printed with writing or symbols such that the words or symbols are illuminated.

As shown in FIG. 4, a light source 24 is positioned within the connector 10 such that light is directed towards the lens 22. The light source 24 is electrically connected to the terminals 18 and 32, providing an indication that the connector 10 is either fully engaged to the receptacle or that the portable device attached to the cord 20 is drawing power from the vehicle's electrical distribution system. The light source may have a variety of configurations, such as a light emitting diode (LED), shown in FIG. 4, or a bulb and socket arrangement.

Alternatively, a connector 10 may be provided with multiple light sources and lenses, one light source and lens indicating that the connector is electrically connected to the receptacle, and another light source and lens indicating that the device is drawing power from the vehicle.

Having described the various embodiments of the present invention with reference to the accompanying figures, it will be appreciated that various changes and modifications can be made without departing from the scope or spirit of the invention.

I claim:

1. An electrical power connector for use with a vehicle having an electrical distribution system including a cigarette lighter receptacle, the connector comprising an opaque elongated body, cylindrical about a longitudinal axis, having an exterior surface and a first end formed with electrically conductive terminals adapted to be inserted into the receptacle to make electrical connection with the electrical distribution system, and wherein the receptacle is of the type which will accept the connector independently of rotational orientation about the longitudinal axis the improvement comprising:

an electrical light source disposed within the body;

circuitry within the body to electrically connect the light source to the electrical distribution system via the receptacle to energize the light source when the first end of the connector is in electrical communication with the receptacle; and a light-transmissive lens encircling a portion of the exterior surface of the body to conduct light from the source exteriorly of the body so as to be visible to an observer regardless of the rotational orientation of the connector within the receptacle.

2. The connector of claim 1, further including a flexible electrical cord extending from a second end of the body, wherein the lens is positioned on the second end of the body and forms a ring about the electrical cord.

3. The connector of claim 1, wherein the lens completely covers a second end of the body.

4. An electrical power connector for use with a vehicle having an electrical distribution system including a cigarette lighter receptacle, the connector comprising an opaque elongated body defining a longitudinal axis extending the length of the body and an exterior, cylindrical surface concentric about the longitudinal axis, the body further including a first end having terminals adapted to be inserted into the receptacle to make electrical connection with the electrical distribution system, and a second end which is exposed when the first end is inserted into the receptacle, the receptacle being configured to accept the connector regardless of the rotational orientation of the connector about the longitudinal axis, and a flexible electrical cord extending from the second end of the body, the cord including an end suitable for attachment to an electrical device, the improvement comprising:

an electrical light source disposed within the body;

circuitry within the body to electrically connect the light source to the electrical distribution system via the receptacle to energize the light source when the connector is in electrical communication with the electrical distribution system; and a lens on the exterior of the body extending fully about a portion of the exterior surface of the body, intermediate the ends of the body and visible to an observer regardless of the rotational orientation of the connector within the receptacle, and adapted to direct light from the source exteriorly of the body when the first end of the connector is in electrical engagement with the electrical distribution system.

5. The connector of claim 1, wherein the flexible electrical cord extends from a second end of the body and the lens forms a ring about the electrical cord on the second end of the body.

6. The connector of claim 4, wherein the lens completely covers the second end of the body.

7. The connector of claim 6, wherein the lens extends to cover substantially all of the second end of the body.

* * * * *